US005771496A

United States Patent [19]

Wood

[11] Patent Number: 5,771,496

[45] Date of Patent: Jun. 30, 1998

[54] READILY INSTALLED POCKET PATCH HAVING REINFORCED SEAM

[76] Inventor: Donald G. Wood, 921 - 30th Avenue Dr., NW., Hickory, N.C. 28601

[21] Appl. No.: 173,065

[22] Filed: Dec. 27, 1993

[51] Int. Cl.[6] ..... A41D 27/00; A41D 27/20

[52] U.S. Cl. ..... 2/248; 2/247; 2/275; 2/243.1

[58] Field of Search ..... 2/247, 248, 249, 2/250, 251, 252, 253, 254, 275, 227, 79, 244, 243.1

[56] References Cited

U.S. PATENT DOCUMENTS

| | | | |
|---|---|---|---|
| 1,133,906 | 3/1915 | Alban | 2/247 |
| 1,883,461 | 10/1932 | Baccaro | 2/247 |
| 1,936,045 | 11/1933 | Bachrach | 2/247 |
| 2,295,425 | 9/1942 | Potter | 2/247 |
| 2,411,328 | 11/1946 | MacNab | 2/243.1 |
| 2,436,879 | 3/1948 | Buck . | |
| 2,685,086 | 8/1954 | Henry | 2/248 |
| 3,060,309 | 12/1962 | Buchanan et al. . | |
| 3,066,309 | 12/1962 | Buchanan et al. | 2/248 |
| 3,163,867 | 1/1965 | Halcomb . | |
| 3,262,128 | 7/1966 | Morgan et al. | 2/400 X |
| 3,562,819 | 2/1971 | Crawford . | |
| 3,723,994 | 4/1973 | Tucker . | |
| 3,725,960 | 4/1973 | Hall . | |
| 4,561,128 | 12/1985 | Zimmerman | 2/275 |
| 4,604,152 | 8/1986 | Liukko | 2/275 X |
| 5,003,902 | 4/1991 | Benstock | 2/275 X |
| 5,156,891 | 10/1992 | Isoe et al. | 2/248 |
| 5,255,392 | 10/1993 | Stanislaw | 2/247 |

FOREIGN PATENT DOCUMENTS

| | | | |
|---|---|---|---|
| 271656 | 6/1964 | Australia . | |
| 4729138 | 8/1972 | Japan | 2/275 |
| 3000023 | 1/1993 | WIPO | 2/248 |

*Primary Examiner*—Jeanette E. Chapman
*Attorney, Agent, or Firm*—Julian C. Renfro, Esq.

[57] ABSTRACT

A repair patch for worn or damaged garment pockets in accordance with this invention comprises a pocket-like member corresponding substantially in size and configuration to the lowermost portion of a pocket to be repaired. Substantially the entire outer surfaces of the repair patch contains a heat sensitive glue capable of being activated at such time as the patch has been inserted into the lowermost portion of the pocket to be repaired. The heat sensitive glue, when activated by heat and pressure applied from the exterior of the pocket, serves to retain the patch securely in position within the lowermost portion of the pocket. Significantly, the patch has an interiorly-turned seam, which seam is reinforced by the glue that had been applied to the exterior surfaces of the patch. The glue-reinforced seam is disposed along an interior outer edge of the patch, such positioning of the seam having been achieved by turning the patch inside out after the seam had been created. The repair patch can be configured so as to be generally triangularly-shaped or rectangularly-shaped, so as to be of appropriate size and configuration for the pocket to be patched.

10 Claims, 4 Drawing Sheets

READILY INSTALLED POCKET PATCH HAVING REINFORCED SEAM

FIELD OF THE INVENTION

This invention relates to a pocket patch to be applied in the interior of a pocket in order to close a hole, and more particularly to a novel patch as well as a novel method for creating the patch.

BACKGROUND OF THE INVENTION

It is well known that the lowermost portions of a garment's pockets, especially the side pockets of men's and youths'trousers, rapidly become worn, and that holes or openings soon develop therein, probably primarily due to the practice of carrying loose change, keys, pen knives, and other objects within such pockets. Obviously, the presence of a hole in the lowermost portion of a garment pocket is highly objectionable, for such a hole frequently results in the loss of money or valuable objects normally carried within a pocket.

A hole or opening in a pocket may also be caused by the breaking or wearing of the stitches by means of which the lowermost portion of a pocket is sewn together, such breaking or wearing of the stitches being caused by the weight of, and by the constant movement within the pocket, of change, keys, pen knives, or other objects. When such a hole develops, either from the wearing away of the material in the lowermost portion of the pocket or from the breaking or wearing of the seam or stitches, it is the usual practice either to remove the entire worn pocket and to replace the same with a new pocket, or to employ the services of a tailor or other person skilled in the art of sewing, to sew up the hole or seam, or to cover such hole or seam with a suitable patch. Such a patch is usually sewn to the outside of the pocket, to overlie the hole or open seam therein, where such a patch may well cause discomfort to the wearer of the trousers. Either of these expedients of repairing worn pockets involves the expenditure of considerable time, and also involves an appreciable item of expense.

My invention, therefore, seeks to provide a particularly ingenious and highly effective patch for the lowermost portion of a worn or damaged pocket, which patch may be readily secured in the interior of the pocket without the necessity of stitching the worn seam or stitching a patch over the hole or holes in the worn or damaged pocket.

SUMMARY OF THE INVENTION

A repair patch for a worn or damaged garment pocket may in accordance with this invention comprise a pocket-like member corresponding substantially in size and configuration to the lowermost portion of the pocket to be repaired. The patch is constructed from a segment of suitable fabric, with heat sensitive glue or some other suitable adhesive applied to one entire surface of the fabric segment, but not to both sides. The glue is to be capable of being activated at such time as the patch has been inserted into the lowermost interior portion of the pocket to be repaired.

So as to create a patch having at least one glue-reinforced seam, the patch is created by initially folding a substantially flat section of fabric of appropriate size onto itself, with the glue side inward. Thereafter a seam is sewn along one open edge of the patch thus created, so as to effect closure of such edge. An adjacent edge is left open. Because the glue is on the interior of the patch at this point, running the seam along the abutting edges serves the significant purpose of securing glue-containing edges tightly together. Thereafter, in a deliberate effort, the patch is turned inside out, thus to dispose the surfaces containing glue on the outside of the patch. As a result, upon the completed patch being inserted into a pocket and disposing it in a hole-closing position therein, the patch can be firmly attached to the interior of the pocket when the glue is activated by heat and pressure applied from the exterior of the pocket. Quite significantly, because the previously mentioned seam was sewn along contiguous glue-containing surfaces, the seam, in a highly advantageous manner, will become glue reinforced at the same time as heat is being applied to the exterior of the pocket, to secure the patch in place.

As will be seen at substantial length hereinafter, one embodiment of my invention pertains to a repair patch for a worn or damaged garment pocket that is generally triangularly-shaped, and another embodiment pertains to a repair patch that is rectangularly-shaped.

It is therefore a principal object of my invention to reinforce and repair a pocket in such a manner that the point of greatest abuse and wear, the bottom seam, becomes the point of greatest strength and reinforcement, due to my novel and highly advantageous design of the glue-reinforced seam.

It is another important object of my invention to effect the repair of a pocket in a novel and unobvious way, resulting in a comfortable, inexpensive and unobtrusive repair.

It is yet another object of my invention to effect the repair of the pocket of a garment without altering its original overall shape or length.

It is still another object of my invention to effect the repair of a pocket without the repairer having to use a sewing machine and without having to hire the services of a professional such as a seamstress or a tailor.

It is yet another object of my invention to provide a pocket repair patch which is stronger than the original pocket being repaired, both in the gluing of reinforcing material to the original pocket fabric as well as in the stitching of the bottom seam of the patch in such a manner that it is actually stronger than the original stitching in the bottom of the original pocket.

It is yet another object of my invention to provide a pocket reinforcement for heavy-duty use which will not only repair damaged pockets, but which would also strengthen whole pockets, to help protect them against damage.

It is yet another object of my invention to provide a novel repair patch for garment pockets as well as to the novel method of creating such a patch, which patch comprises a relatively small piece of fabric folded and sewed in a novel, reinforced manner, such that it conforms substantially in size and configuration to the pocket, with glue having been applied to the exterior of such patch, for retaining the patch in the most appropriate lower interior portion of the pocket.

It is yet another object of my invention to provide a relatively small and inexpensive patch of a size and configuration corresponding substantially to the lowermost portion of a pocket, utilizing a strongly reinforced seam and having applied to its outward surface, an adhesive of the type which is substantially non-tacky and non-sticky at normal temperatures, and which adhesive may be rendered tacky and sticky by the application of a solvent, or by the application of heat, such as the heat of an ordinary pressing iron, and which adhesive then serves as a means for attaching the patch to the interior of the pocket in what may be regarded as a permanent manner.

It is yet another object of my invention to provide a pocket repair patch of the type above specified, that is cheap and easy to manufacture, simple for even an unskilled person to apply, and that is strong and durable because of the use in the construction of the patch of a novel, highly effective, doubly-reinforced seam.

These and other objects, features and advantages will become more apparent from a study of the appended drawings and the descriptive material associated therewith.

DETAILED DESCRIPTION

Figure 1:
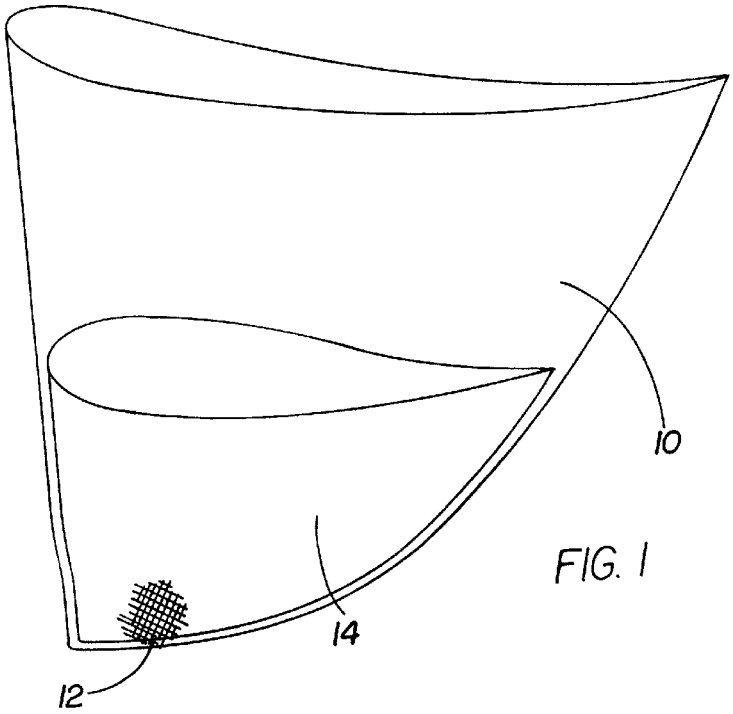
FIG. 1 is a perspective-type drawing of the lower portion of a trousers pocket, showing a first embodiment of my novel, reinforced seam patch inserted into a lower interior portion of the pocket, at the location of a hole.

With initial reference to FIG. 1, it will be seen that I have illustrated a pocket 10, such as a front trousers pocket, having a hole 12 therein. I have found that frequently a hole develops in the bottom seam of the pocket, or in a location relatively close to the bottom seam, but this is not always the case.

Into the bottom of this pocket, a pocket patch 14 in accordance with this invention has been inserted, so as to effect closure of the hole 12. It will be noted from FIG. 1 as well as certain figures that follow that the patch 14 in accordance with this first embodiment of my invention is of generally triangular configuration, although the lower edge typically is of curved or arcuate configuration rather than being precisely straight.

As will be described at some length hereinafter, the generally triangularly shaped patch 14 of FIG. 1 is installed in the interior of the pocket 10 in what may be regarded as a permanent manner, typically such installation being accomplished by heat and pressure applied to the exterior of the pocket. As is obvious, an iron of the type to be found in almost every household may be used to install the patch in the bottom of the pocket, at a location in which the patch will be effective to close the hole in the pocket.

Figure 2:
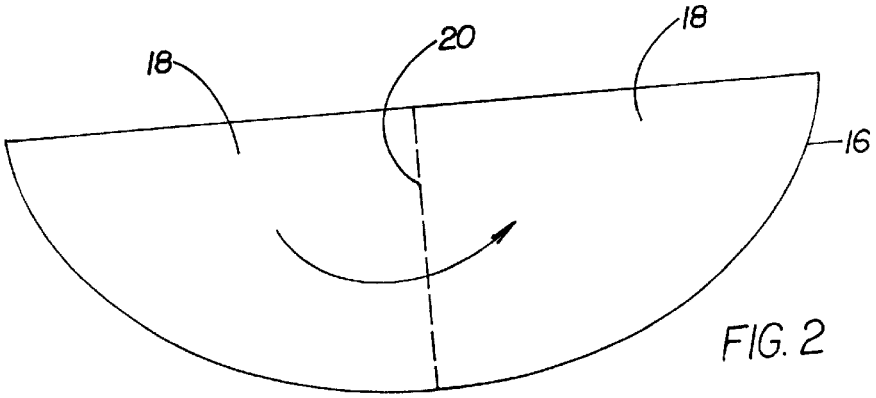
FIG. 2 is a segment of cloth of generally arcuate configuration, to one surface of which glue has been applied, this figure revealing the segment of cloth prior to being folded upon itself.

A patch in accordance with the first embodiment of my invention depicted in FIG. 1 is created by selecting an elongate segment 16 of a suitable type of cloth or other type of material suitable for a use of this type, with the segment typically being of arcuate configuration, as shown in FIG. 2. Quite importantly, a layer of glue 18 of appropriate type is applied one side of the segment 16. I preferably utilize a heat-sensitive glue for this purpose such as 3M glues #583 or #588, but I an obviously not to be limited to any particular type or brand. I have found the simplest construction is to cut the elongate segment 16 out of fabric to which the heat-sensitive glue has already been applied by the manufacturer of the cloth.

Figure 3:
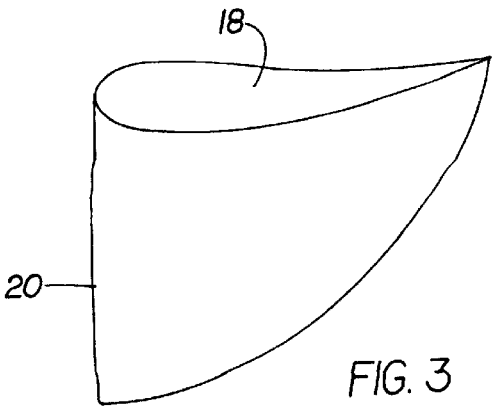
FIG. 3 is a view of the segment of cloth appealing in FIG. 2, after the segment has been folded at a mid point, and the two halves of the segment brought together to form a generally triangularly-shaped patch, with the edges in generally aligned relationship, and with the glued surfaces in a facing, adjacent relationship in the interior of the patch.

As shown in FIG. 3, the pocket patch 14 has been created by folding the segment of cloth upon itself, with the fold occurring at the centerline location 20 represented by the dashed line in FIG. 2. Care must be taken to assure that the sides or portions of the patch upon which the glue has been applied are at this time residing on the interior of the patch.

It is thus to be seen that by folding the segment of cloth at the location 20 in FIG. 2, a patch having a pair of aligned, open edges adjacent each end of the fold has been created. I prefer to describe this patch as generally triangularly shaped, even though the bottom edge of the pocket, as previously mentioned, may be of arcuate configuration instead of being straight.

Figure 4:
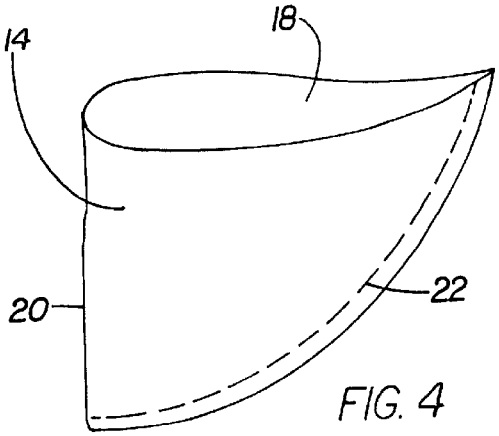
FIG. 4 is a view similar to FIG. 3, but showing one set of aligned edges having been secured together by a seam, with it to be noted that the seam is reinforced by the construction I prefer, which involves juxtaposing and then stitching the pocket patch surfaces that contain glue.

With reference to FIG. 4, it will be seen that this view is quite similar to FIG. 3, with the difference being that a seam 22 has been stitched along one pair of open edges, to effect the closure of the bottom of the patch. Significantly, the other pair of open edges are left open and unsealed.

It is most important to realize that the glue-containing surfaces 18 of the patch are in a closely abutting, facing relationship at the time the seam 22 has been stitched across the lower set of abutting edges in the manner shown in FIG. 4, whereas at this particular point, the exterior of the pocket patch involves surfaces to which no glue has been applied.

As a consequence of this arrangement, after the patch is turned inside out, an extremely strong, reinforced seam is created at the time that heat and pressure are subsequently used to seal the patch in the desired location in the bottom of the pocket, since the seam 22 is both stitched and glue-reinforced. This highly advantageous arrangement is a principal feature of my invention.

Figure 5:
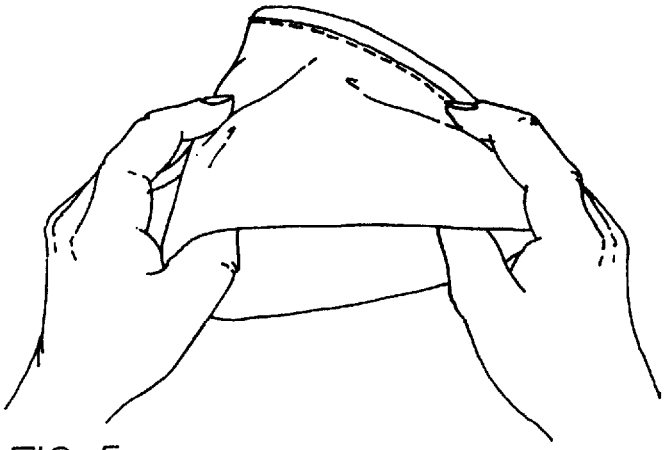
FIG. 5 is a view revealing in accordance with the novel procedure forming an important part of my invention, how a manufacturer goes about turning the pocket patch inside out after the stitching step, thus to bring the glue coated surfaces out of the interior of the pocket.

With regard to the generally triangularly-shaped patch being created in accordance with this embodiment of my invention, it is important to note that after stitching, the patch must be turned inside out in the general manner shown in FIG. 5, in order to place the glue-containing surfaces on the exterior of the patch, with the surfaces containing no glue now being on the interior of the pocket patch.

Figure 6:
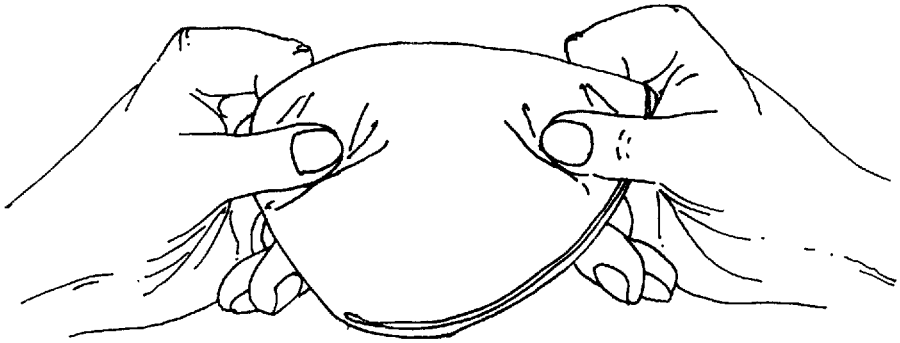
FIG. 6 is a view related to FIG. 5 and revealing the procedure of turning the pocket patch inside out. as it nears completion.

As shown in FIG. 6, the procedure of turning the patch inside out is nearing completion, and at this point, the stitched, glue-reinforced edges of the seam are to be understood as residing on the inside of the patch. As should be obvious, heat-activated glue containing surfaces intended to contact the interior of the pocket no longer remain inside the pocket patch.

Figure 7:
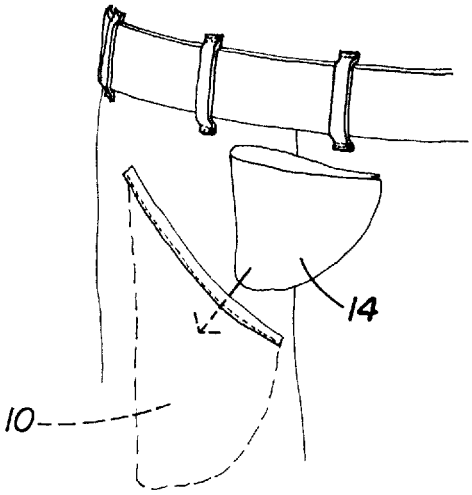
FIG. 7 is a view taken to a somewhat smaller scale and revealing that the reinforced seam patch in accordance with the first embodiment of my invention is to be inserted into the interior of the pocket to be patched.

As shown in FIG. 7, the generally triangularly-shaped patch 14 is then to be placed inside the front pocket 10 of trousers, at the location of the hole 12, with care being taker. to place the patch in a position in which it is in substantial conformance with the configuration of the interior of the pocket, and residing in a hole-closing relationship. At such time as the patch has been properly placed in the pocket, it is to be sealed t$D the interior of the pocket by heat and pressure applied to the exterior of the pocket. This of course causes the glue-containing exterior surfaces of the patch to adhere securely to the interior of the pocket at the location of the hole, in what may be regarded as a permanent manner.

Significantly, the heat and pressure utilized to cause the patch to adhere to the interior of the pocket also causes the edges of the stitched seam to adhere closely together, thus serving to doubly reinforce the edges of the stitched seam, and assure against an undesired opening of the seam during use. I prefer to describe the arcuately shaped bottom seam of my novel pocket patch either as being a glue-reinforced seam or as a doubly-reinforced seam.

Figure 8:
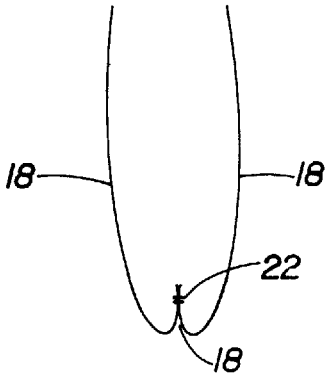
FIG. 8 is a cross-section of a completed pocket reinforcer, illustrating a first embodiment of my novel, glue reinforced and inwardly-turned bottom seam.

FIG. 8 represents a cross-sectional view of the completed ready-to-install pocket patch, revealing the appearance of the seam 22 after this first embodiment of my novel pocket patch has been turned inside-out, with it being obvious that the resulting, doubly-reinforced seam is much stronger than an ordinary seam in that the glue reinforcement 18 serves to hold the two sides of the pocket patch together in a particularly strong and highly reinforced manner. At this time, the glue-infused surfaces 18 of the pocket patch are on the exterior of the patch as well as on the facing, abutting portions of the stitched seam.

Figure 9:
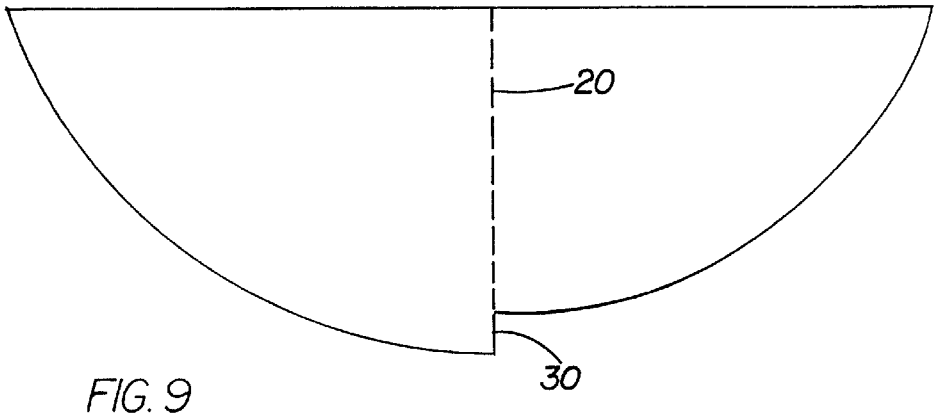
FIG. 9 is a figure generally along the lines of FIG. 2, but differing in that it reveals the asymmetrical shape used in accordance with an alternate construction of a generally triangularly-shaped pocket patch.
Figure 10:
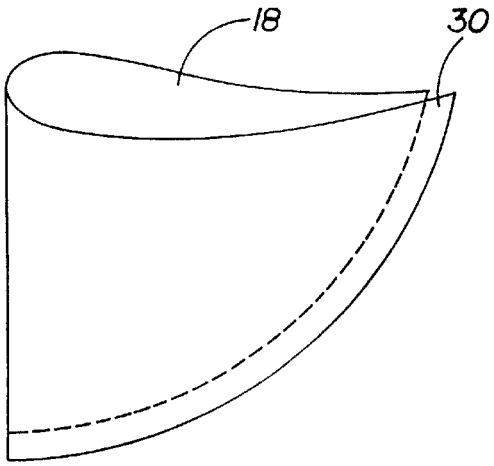
FIG. 10 is a view generally similar to FIG. 3, but showing an elongate segment extending past its opposite side after being folded at midpoint.
Figure 11:
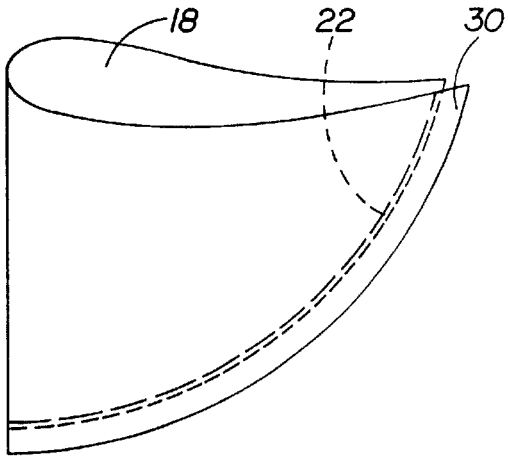
FIG. 11 is a view of this alternate version of a generally triangularly-shaped pocket reinforcer after the stitching step, showing the stitching of the curved edges together, with an elongate segment extending out beyond the stitching.

With reference now to FIGS. 9 through 11, it is to be seen that these figures represent an alternate construction of a generally triangularly-shaped pocket patch in accordance with my invention. In reality, these three figures are substantially identical to their counterparts depicted in FIGS. 1, 3 and 4, with the exception of the addition of an asymmetrical, elongate portion 30 extending along one side of the segment. FIG. 9 shows the exposed flap or elongate portion 30 on one side of the segment, extending from one end to the midpoint 20 of the material.

As shown in FIG. 10, the material constituting this alternative embodiment of a generally triangularly-shaped patch has been folded upon itself along its midpoint so that the glue-containing surfaces 18 are facing each other. To be noted in this instance is the fact that the elongate portion or flap 30 extends past the opposite side of the segment of cloth, in accordance with this alternate construction.

FIG. 11 shows the stitching 22 of the curved edges together, with the elongate portion or flap 30 extending cut beyond the stitching. After stitching, the material is turned inside-out and inserted into the pocket which is being repaired, in the same manner as was shown in FIGS. 5, 6 and 7.

Figure 12:
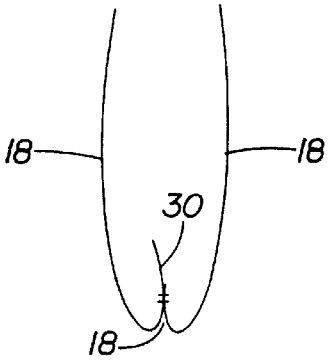
FIG. 12 is a cross-sectional view showing this alternate version of the pocket reinforcer, illustrating the same novel heat-set glue reinforced and inwardly turned bottom seam, but with one side of the bottom seam extending past the other.

FIG. 12 is a cross-sectional view, generally resembling FIG. 8, which shows that the alternate construction has the same heat-set glue reinforced seam as the original version, with the exception of the elongate portion or flap 30, which extends upward from the seam and which is understood to run the length of the seam. It will be seen upon examination that the glue-containing side 18 of this flap is positioned to seal itself against the opposite side of the pocket interior upon the application of pressure and heat, typically by the application of an iron at the proper temperature.

Figure 13:
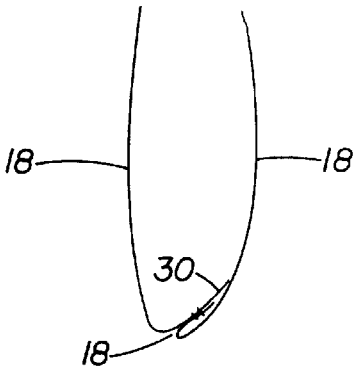
FIG. 13 is a cross-sectional view showing how the extended side of the seam seals against the inside of the pocket upon application of heat and pressure, i.e. ironing the pocket reinforcer into the pocket which is being repaired.

FIG. 13 is a cross-sectional view which shows the exposed elongate portion or flap 30 about to be sealed over against the opposite side. It should be noted that in this case, the application of heat and pressure accomplishes three things simultaneously:

1. The pocket reinforcing patch is permanently bonded into position in the pocket, and although the pocket itself has in this instance been omitted in the interests of clarity, it will nevertheless be understood that this bonding of my novel patch is a consequence of the action of the heat-set glue on its exterior surface, which of course abuts the interior surface of the pocket;
2. The stitched bottom seam of the pocket reinforcer becomes itself glue-reinforced due to the action of the heat-set glue on the two glue-containing abutting surfaces, which face each other at the bottom of the patch; and
3. The elongate portion or exposed flap 30 seals itself against the opposite interior side of the pocket reinforcer, thus adding even more strength to the bottom seam, as well as hiding the exposed edges of the seam, and therefore resulting in a smoother pocket.

The use of a relatively simple seam to join the components of the pocket patch together, as was depicted in FIG. 8, is quite suitable and highly effective for most applications. Nevertheless, I may, as one alternative, prefer to utilize a hemmed edge rather than simple stitching, although I would always utilize the glue-reinforced seam.

It is to be understood that I am not to be limited to the use of traditional fabrics such as cotton in the manufacture of the repair patch, as other materials, such as various types and weights of fabric could be used, as well as certain synthetic materials.

Likewise, I am not to be limited in the use of the heat-activated glues named herein, as other brands or types of glue could be used to create the double reinforced seam.

Figure 14:
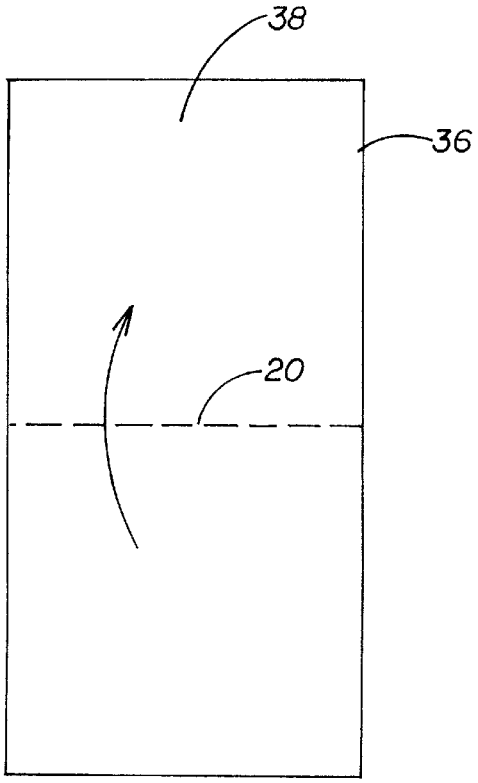
FIG. 14 is a view somewhat along the lines of FIG. 2, but revealing a piece of flat material about to be folded so as to commence the creation of a rectangularly-shaped pocket patch in accordance with another embodiment of my invention.
Figure 15:
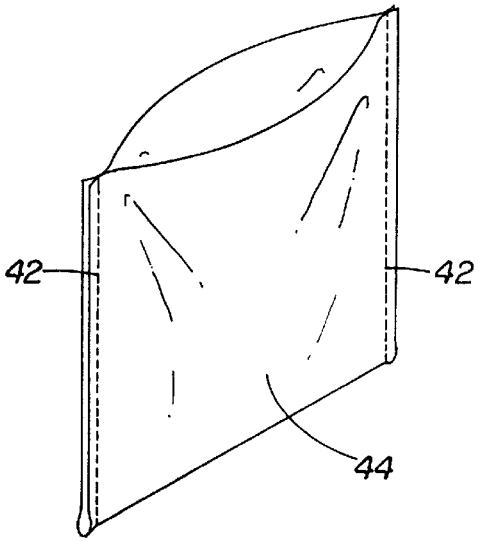
FIG. 15 is a related figure, showing the piece of material of FIG. 14 having been folded at its midpoint, and with stitches extending up each side.

Turning now to FIG. 14, I reveal a rectangular segment of cloth 36 that is about to be folded upon itself to form a rectangularly-shaped pocket patch 44 in accordance with an alternative form of by invention; note FIG. 15. Glue has been applied to the entire surface of the cloth segment 36, which I refer to as the glue side 38 of the patch. After the folding has been accomplished along the center seam 20, I then run a seam 42 up each side of the rectangularly-shaped patch in the manner shown in FIG. 15, so as to create a repair patch 44 that is closed on three sides, but with the top edge open.

Figure 16:
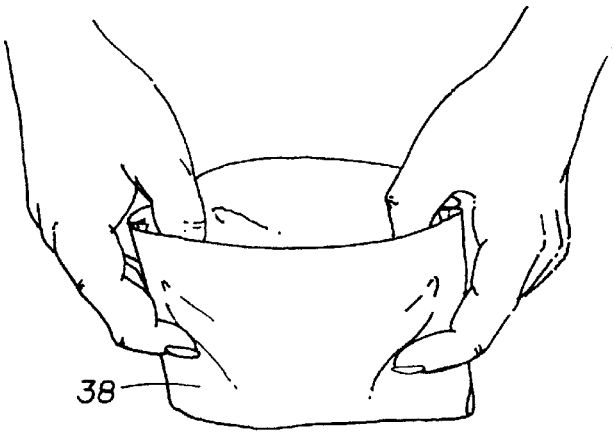
FIG. 16 is a view revealing how the manufacturer goes about turning the component shown in FIG. 15 inside out, so as to place the glue on the outside of the pocket.
Figure 17:
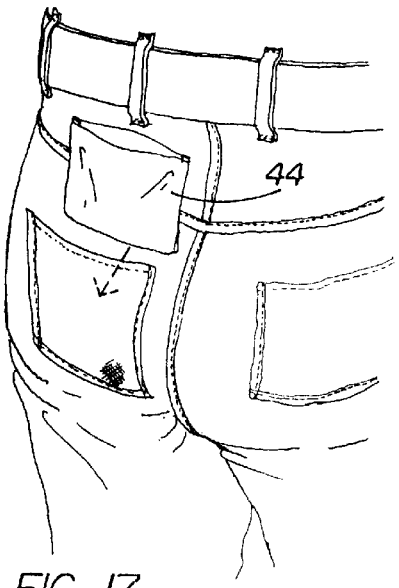
FIG. 17 shows the completed rectangularly-shaped pocket patch about to be inserted into a rectangularly-shaped pocket, such as the hip pocket of trousers, which step is followed by the application of heat from an iron or the like, so as to cause the glue to set and attach the patch on the interior of the pocket.

As in the case of the generally triangularly-shaped patch, I reveal in FIG. 16 the patch 44 being turned inside out, thus to bring the glue coated surfaces 38 from the interior to the exterior of the patch. This completes the rectangularly-shaped patch, which is now ready to be inserted into a rectangularly-shaped pocket, such as typically to be utilized as a hip pocket of trousers; note FIG. 17 in this regard. The application of a hot iron to the hip pocket of the trousers now causes the repair patch to adhere tightly to the cloth that originally constituted the pocket of the trousers.

In conjunction with my rectangularly-shaped pocket patch, it is to be understood that occasionally it is desirable to repair a pocket of a width that is less than standard width. In such an instance, it may be desirable to cut the pocket patch in a direction paralleling the seams 42, so as to create two unequal-size portions. The larger portion is then inserted snugly into the bottom and against one side edge of the pocket to be repaired. This larger patch portion is typically placed on the part of the pocket in which the hole is present. Heat and pressure are now applied to seal this one portion of the pocket patch into its final position, in which most but not all of the rectangular-shaped pocket has a highly satisfactory insert.

The remaining, somewhat smaller portion of the cut pocket patch is now inserted snugly against the bottom of the pocket, and against the side edge of the pocket previously left uncovered. Upon this smaller portion of the pocket patch now having been positioned appropriately, heat and pressure are again applied, thereby sealing this remaining portion of the patch into the position that completes the repair of this non-standard size rectangular pocket. This arrangement typically involves a portion of the glue on the smaller portion of the pocket patch affixing itself to the interior of the larger portion of the patch.

It is now to be seen that I have shown several embodiments of a pocket patch having the unusual property of one or a pair of seams that are doubly reinforced, in that such seam or seams utilize stitching as well as glue to assure the creation of a seam that is quite unlikely to wear out in normal use.

I claim:

1. A repair patch for worn or damaged garment pockets, comprising a pocket-like member to be installed in a pocket having an exterior, an interior, and a lowermost portion, said patch having exterior surfaces and corresponding substantially in size and configuration to the lowermost portion of the pocket to be repaired, heat sensitive glue applied to the exterior surfaces of said patch, such glue being adapted to engage the fabric of the interior of the pocket to which said patch is applied, such glue serving when activated, to retain said patch in a selected position within the lowermost portion of the pocket, said repair patch having at least one interiorly-turned seam, which seam is reinforced by the glue that had been applied to the exterior surfaces of the patch.

2. The repair patch as recited in claim 1 in which said glue-reinforced seam is disposed along an interior edge of the repair patch, such positioning of the seam having been achieved by turning the patch inside-out after the seam had been created.

3. The repair patch as recited in claim 2 in which said repair patch is generally triangularly-shaped.

4. The repair patch as recited in claim 2 in which said repair patch is rectangularly-shaped.

5. A repair patch for worn or damaged garment pockets, comprising a pocket-like member having outer surfaces and corresponding substantially in size and configuration to the lowermost portion of the pocket to be repaired, which pocket has an exterior, an interior, and a lowermost portion, substantially the entire outer surfaces of said repair patch containing a heat sensitive glue capable of being activated at such time as said patch has been inserted into the lowermost portion of the pocket to be repaired, such heat sensitive glue, when activated by heat and pressure applied from the exterior of the pocket, serving to retain said patch securely in position within the lowermost portion of the pocket, said patch having at least one interiorly-turned seam, which seam is reinforced by the glue that had been applied to the exterior surfaces of the patch.

6. The repair patch as recited in claim 5 in which said glue-reinforced seam is disposed along an interior edge of the patch, such positioning of the seam having been achieved by turning the patch inside out after the seam had been created.

7. The repair patch as recited in claim 6 in which said repair patch is generally triangularly-shaped.

8. The repair patch as recited in claim 6 in which said repair patch is rectangularly-shaped.

9. The method for patching a hole in a pocket by the selected application of heat and pressure to the exterior of a pocket having an exterior, an interior, and a lowermost portion, such heat and pressure being applied subsequent to the insertion of a generally triangularly-shaped patch into the interior of the pocket, said method comprising the steps of:

a. selecting an elongate, generally arcuately-shaped segment of cloth, upon one side of which, heat sensitive glue has been applied;

b. forming a generally triangularly-shaped patch by folding the segment of cloth upon itself so as to create interior and exterior portions, with the side upon which the glue has been applied being on the interior of the patch, thus to create a generally triangularly-shaped member having a pair of aligned, open edges adjacent each end of the fold;

c. stitching a seam along one pair of glue-containing, open edges, to effect the closure of the edges, with the other pair of open edges being left open and unsealed;

d. turning said patch inside out, thus to place on the exterior of the patch, the surfaces upon which glue had been applied, with the stitched edges of the seam residing on the inside of the patch;

e. placing said patch inside the pocket at the location of the hole, with the open edges extending upwardly;

f. applying heat and pressure to the exterior of the pocket at the location of the patch, thus causing the glue to activate, and said patch to adhere securely to the interior of the pocket at the location of the hole;

g. the heat and pressure used to cause the patch to adhere to the interior of the pocket also causing the edges of the stitched seam to adhere closely together, thus serving to doubly reinforce the edges of the stitched seam, and assure against an undesired opening of the seam during use.

10. The method for patching a hole in a pocket by the selected application of heat and pressure to the exterior of a pocket having an exterior, an interior, and a lowermost portion, the heat and pressure being subsequent to the insertion of a rectangularly-shaped patch into the interior of the pocket, said method comprising the steps of:

a. selecting an elongate segment of cloth, upon one entire side of which, heat sensitive glue has been applied;

b. forming a generally rectangularly-shaped patch having an exterior and an interior by folding the segment of cloth upon itself, with the side upon which the glue has been applied being on the interior of the patch, thus to create a generally rectangularly-shaped member having a pair of aligned, open edges adjacent the fold;

c. stitching a seam along both glue-containing, open edges, to effect the closure of the edges, with the top edge being left open and unsealed;

d. turning said patch inside out, thus to place on the exterior of the patch, the surfaces upon which glue had been applied, with the stitched edges of the seams residing on the inside of the patch;

e. placing said patch inside the pocket at the location of the hole, with the open edge extending upwardly;

f. applying heat and pressure to the exterior of the pocket at the location of the patch, thus causing the glue to activate, and said patch to adhere securely to the interior of the pocket at the location of the hole;

g. the heat and pressure used to cause the patch to adhere to the interior of the pocket also causing the edges of the stitched seams to adhere closely together, thus serving to doubly reinforce the edges of the stitched seams, and assure against an undesired opening of the seams during use.

* * * * *